US010848887B2

(12) United States Patent
Luke et al.

(10) Patent No.: US 10,848,887 B2
(45) **Date of Patent: *Nov. 24, 2020**

(54) BLOCKED MICROPHONE DETECTION

(71) Applicant: Cirrus Logic International Semiconductor Ltd., Edinburgh (GB)

(72) Inventors: Robert Luke, Richmond East (AU); Vitaliy Sapozhnykov, Cremorne (AU); Thomas Ivan Harvey, Cremorne (AU)

(73) Assignee: Cirrus Logic, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/515,934

(22) Filed: Jul. 18, 2019

(65) Prior Publication Data

US 2019/0342683 A1 Nov. 7, 2019

Related U.S. Application Data

(63) Continuation of application No. 16/026,103, filed on Jul. 3, 2018, now Pat. No. 10,412,518.

(Continued)

(51) Int. Cl.

*H04R 29/00* (2006.01)
*H04R 1/40* (2006.01)

(Continued)

(52) U.S. Cl.

CPC ..... *H04R 29/005* (2013.01); *H04R 1/406* (2013.01); *H04R 3/005* (2013.01); *H04R 29/004* (2013.01); *H04R 1/10* (2013.01); *H04R 2410/07* (2013.01)

(58) Field of Classification Search

CPC ..... H04R 29/05; H04R 1/406; H04R 3/005; H04R 29/004

See application file for complete search history.

(56) References Cited

U.S. PATENT DOCUMENTS

2009/0175466 A1* 7/2009 Elko ..... H04R 25/407 381/94.2
2009/0196429 A1* 8/2009 Ramakrishnan ..... H04R 29/004 381/26

(Continued)

FOREIGN PATENT DOCUMENTS

WO 2013091021 A1 6/2013
WO 2014037765 A1 3/2014

(Continued)

OTHER PUBLICATIONS

International Search Report and Written Opinion of the International Searching Authority, International Application No. PCT/GB2018/051890, dated Sep. 19, 2018.

(Continued)

*Primary Examiner* — Simon King
(74) *Attorney, Agent, or Firm* — Jackson Walker L.L.P.

(57) ABSTRACT

Detection of a blocked microphone involves receiving microphone signals from a plurality of microphones. A plurality of signal feature measures are derived from the microphone signals. The signal feature measures are normalised. The normalised signal feature measures are variably weighted in response to detected environmental conditions in the microphone signals. The variably weighted normalised signal feature measures are combined to produce an output indication of whether a microphone is blocked.

20 Claims, 4 Drawing Sheets

Related U.S. Application Data

(60) Provisional application No. 62/529,295, filed on Jul. 6, 2017.

(51) Int. Cl.
*H04R 3/00* (2006.01)
*H04R 1/10* (2006.01)

(56) References Cited

U.S. PATENT DOCUMENTS

2011/0317848 A1 12/2011 Ivanov et al.
2013/0329895 A1 12/2013 Dusan et al.
2014/0105416 A1* 4/2014 Huttunen ..... H04R 5/027 381/92
2014/0270199 A1* 9/2014 Takamatsu ..... H04R 29/004 381/56
2015/0124980 A1* 5/2015 Vilermo ..... H04R 3/005 381/58
2015/0304786 A1 10/2015 Partio et al.
2016/0127845 A1* 5/2016 Cagdaser ..... H04R 29/004 381/58
2016/0134966 A1* 5/2016 Fitzgerald ..... H04R 3/00 381/123
2016/0219524 A1 7/2016 Xu et al.
2016/0373872 A1 12/2016 Chen et al.
2017/0006195 A1 1/2017 Tisch et al.
2017/0084294 A1* 3/2017 Hartung ..... H04R 27/00
2017/0272878 A1* 9/2017 Partio ..... H04R 3/04
2018/0139554 A1 5/2018 Yang et al.

FOREIGN PATENT DOCUMENTS

WO WO-2014037765 A1 * 3/2014 ..... G10K 11/16
WO WO-2014037766 A1 * 3/2014 ..... H04R 3/04
WO 2014149050 A1 9/2014
WO WO-2017146970 A1 * 8/2017 ..... H04R 3/005

OTHER PUBLICATIONS

Suarez-Alvarez, M.M. et al., "Statistical Approach to Normalization of Feature Vectors and Clustering of Mixed Datasets", Royal Society of London, Proceedings, Matehmatical, Physical and Engineering Sciences, vol. 468, No. 2145, Sep. 8, 2012, pp. 2630-2651.

* cited by examiner

BLOCKED MICROPHONE DETECTION

The present disclosure is a continuation of U.S. Non-Provisional patent application Ser. No. 16/026,103, filed Jul. 3, 2018, now Pat. No. 10,412,518, which claims priority to U.S. Provisional Patent Application Ser. No. 62/529,295, filed Jul. 6, 2017, each of which is incorporated by reference herein in its entirety.

FIELD OF THE INVENTION

The present invention relates to an audio processing system capable of detecting when a microphone has been blocked, obstructed or occluded, in order for signal processing to respond appropriately to such events. The present invention further relates to a method of effecting such a system.

BACKGROUND OF THE INVENTION

A wide range of audio processing systems exist which capture audio signals from one or microphones and undertake one or more signal processing tasks on the microphone signal(s) for various purposes. For example, headsets are a popular way for a user to listen to music or audio privately, or to make a hands-free phone call, or to deliver voice commands to a voice recognition system. A wide range of headset form factors, i.e. types of headsets, are available, including earbuds, on-ear (supraaural), over-ear (circumaural), neckband, pendant, and the like, each of which provide one or microphones at various locations on the device in order to capture audio signals such as the user's speech or environmental noise.

There are numerous audio processing algorithms which depend heavily on the unimpeded exposure of microphones to the acoustic environment. For example, devices with multiple sensors or microphones may contain algorithms to process the multiple sources of data, and in such algorithms it is usually assumed that the measurements from each sensor are of equal quality. However, the performance of many such algorithms is markedly degraded if any of the microphones is partly or wholly blocked, obstructed or occluded. A blocked microphone may for example be caused by the user touching or covering the microphone port, or by the ingress of dirt, clothing, hair or the like into the microphone port. A microphone may be blocked only briefly such as when touched by the user, or may be blocked for a long period such as when caused by dirt ingress. The performance of the numerous processing algorithms which may act upon the microphone signal can be heavily influenced or degraded by a blocked microphone.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In this specification, a statement that an element may be "at least one of" a list of options is to be understood that the element may be any one of the listed options, or may be any combination of two or more of the listed options.

SUMMARY OF THE INVENTION

According to a first aspect, the present invention provides a signal processing device for detecting a blocked microphone, the device comprising:

a plurality of inputs for receiving respective microphone signals from a plurality of microphones; and a processor configured to derive from the microphone signals a plurality of signal feature measures, the processor further configured to normalise the signal feature measures; the processor further configured to variably weight the normalised signal feature measures in response to detected environmental conditions in the microphone signals; the processor further configured to combine the variably weighted normalised signal feature measures to produce an output indication of whether a microphone is blocked.

According to a second aspect, the present invention provides a method for detecting a blocked microphone, the method comprising:

receiving respective microphone signals from a plurality of microphones;

deriving from the microphone signals a plurality of signal feature measures;

normalising the signal feature measures;

variably weighting the normalised signal feature measures in response to detected environmental conditions in the microphone signals; and combining the variably weighted normalised signal feature measures to produce an output indication of whether a microphone is blocked.

According to a third aspect, the present invention provides a non-transitory computer readable medium for detecting a blocked microphone, comprising instructions which, when executed by one or more processors, causes performance of the following:

receiving respective microphone signals from a plurality of microphones;

deriving from the microphone signals a plurality of signal feature measures;

normalising the signal feature measures;

variably weighting the normalised signal feature measures in response to detected environmental conditions in the microphone signals; and combining the variably weighted normalised signal feature measures to produce an output indication of whether a microphone is blocked.

According to a fourth aspect, the present invention provides a system for detecting a blocked microphone, the system comprising a processor and a memory, the memory containing instructions executable by the processor and wherein the system is operative to:

receive respective microphone signals from a plurality of microphones;

derive from the microphone signals a plurality of signal feature measures;

normalise the signal feature measures;

variably weight the normalised signal feature measures in response to detected environmental conditions in the microphone signals; and combine the variably weighted normalised signal feature measures to produce an output indication of whether a microphone is blocked.

In some embodiments of the invention, normalising the signal feature measures comprises applying a non-linear mapping of each signal feature measure to a unitless reference scale. For example in some embodiments of the invention, the non-linear mapping comprises a sigmoid function. The sigmoid function may apply a threshold and a slope which are each responsive to observed conditions, such as background noise. The sigmoid function may in some embodiments be configured by reference to control observations of blocked and unblocked microphones. The sigmoid function threshold and slope may in some embodiments be configured dynamically in response to changes in environmental conditions observed in the microphone signals. In some embodiments of the invention, the unitless reference scale outputs a value between 0 and 1, inclusive, or between −1 and 1, inclusive. In some embodiments the non-linear mapping comprises a piecewise linear function.

In some embodiments of the invention, combining the variably weighted normalised signal feature measures may comprise determining a group difference of a signal feature measure of one microphone as compared to the signal feature measure of at least one other of the microphones. For example, the signal feature measure of the one microphone may be compared to the signal feature measure of all other microphones, or to only those other microphones which are not experiencing wind noise, and/or to only those other microphones which are not blocked.

In some embodiments of the invention, the plurality of signal feature measures comprises a signal feature of background noise power, and/or sub-band background noise power, and/or low frequency sub-band background noise power such as below 500 Hz, and/or high frequency sub-band background noise power such as above 4 kHz. A background noise power signal feature may be produced by using minimum controlled recursive averaging for noise estimates. The plurality of signal feature measures may comprise total signal variation, total entropy, signal correlation, coherence and/or a wind metric.

In some embodiments of the invention, feature matching may be applied in order to account for differences arising in the signal features for reasons other than microphone blockage. For example, the feature matching may match the features across sensors by removing the smoothed difference of each channel from the mean value of all the sensors. The feature matching in some embodiments may be based on an initial time period of microphone data, updated using a slow time constant. In such embodiments, the time constant used for feature matching may be further slowed in response to detection of a blocked microphone and/or wind noise. In some embodiments the feature matching may match the features across sensors by applying a fixed correction factor derived during device production.

In some embodiments of the invention, the detected environmental conditions in the microphone signals in response to which the signal feature measures are variably weighted comprises wind noise conditions.

The system may be a headset such as an earbud, a smartphone or any other system with microphones.

BRIEF DESCRIPTION OF THE DRAWINGS

An example of the invention will now be described with reference to the accompanying drawings, in which.

DETAILED DESCRIPTION OF PREFERRED EMBODIMENTS

Figure 1A:
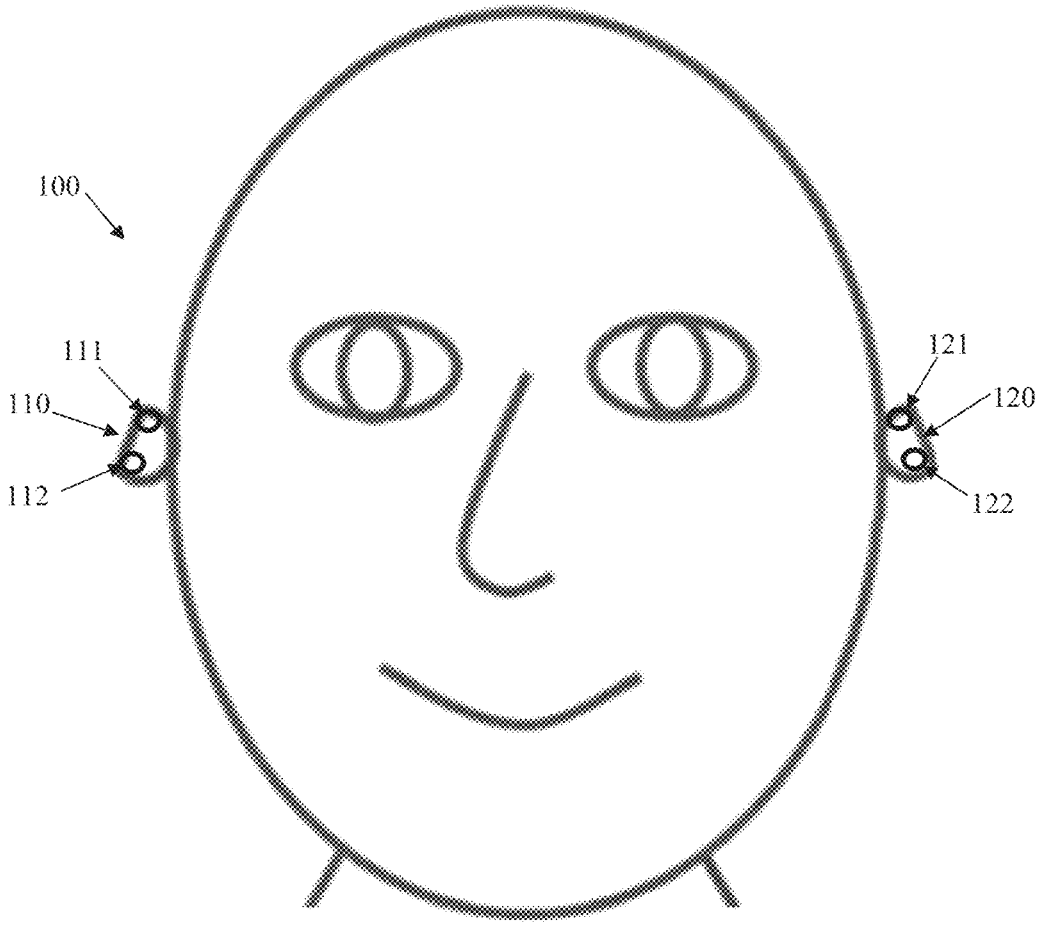
FIG. 1*a* and FIG. 1*b* illustrate a signal processing system comprising a wireless earbuds headset, in which blocked microphone detection is implemented.
Figure 1B:
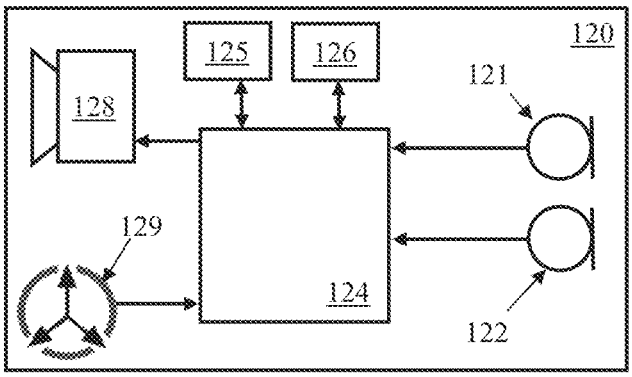

FIGS. 1*a* and 1*b* illustrate a headset 100 in which blocked microphone detection is implemented. Headset 100 comprises two wireless earbuds 110 and 120, each comprising two microphones 111, 112 and 121, 122, respectively. FIG. 1*b* is a system schematic of earbud 120. Earbud 110 is configured in substantially the same 20 manner as earbud 120 and is thus not separately shown or described. A digital signal processor 124 of earbud 120 is configured to receive microphone signals from earbud microphones 121 and 122. Headset 100 is configured for a user to listen to music or audio, to make telephone calls, and to deliver voice commands to a voice recognition system, and other such audio processing functions.

Processor 124 is further configured to adapt the handling of such audio processing functions in response to occasions when one or more of the microphones 121, 122, 111, 112 are blocked, obstructed or occluded, as for example may be caused by the user touching or covering the respective microphone port(s), or by the ingress of dirt, clothing, hair or the like into the respective microphone port(s). Earbud 120 further comprises a memory 125, which may in practice be provided as a single component or as multiple components. The memory 125 is provided for storing data and program instructions. Earbud 120 further comprises a transceiver 126, which is provided for allowing the earbud 120 to communicate wirelessly with external devices, including earbud 110. Earbud 110 is configured to wirelessly transmit signals, and/or signal features, derived from microphones 111, 112 from earbud 110 to earbud 120. This assists processor 124 of earbud 120 to execute blocked microphone detection as discussed further below. Such communications between the earbuds may alternatively comprise wired communications in alternative embodiments where suitable wires are provided between left and right sides of a headset. Earbud 120 further comprises a speaker 128 to deliver sound to the ear canal of the user, and may comprise other sensors such as an accelerometer 129.

Figure 2:
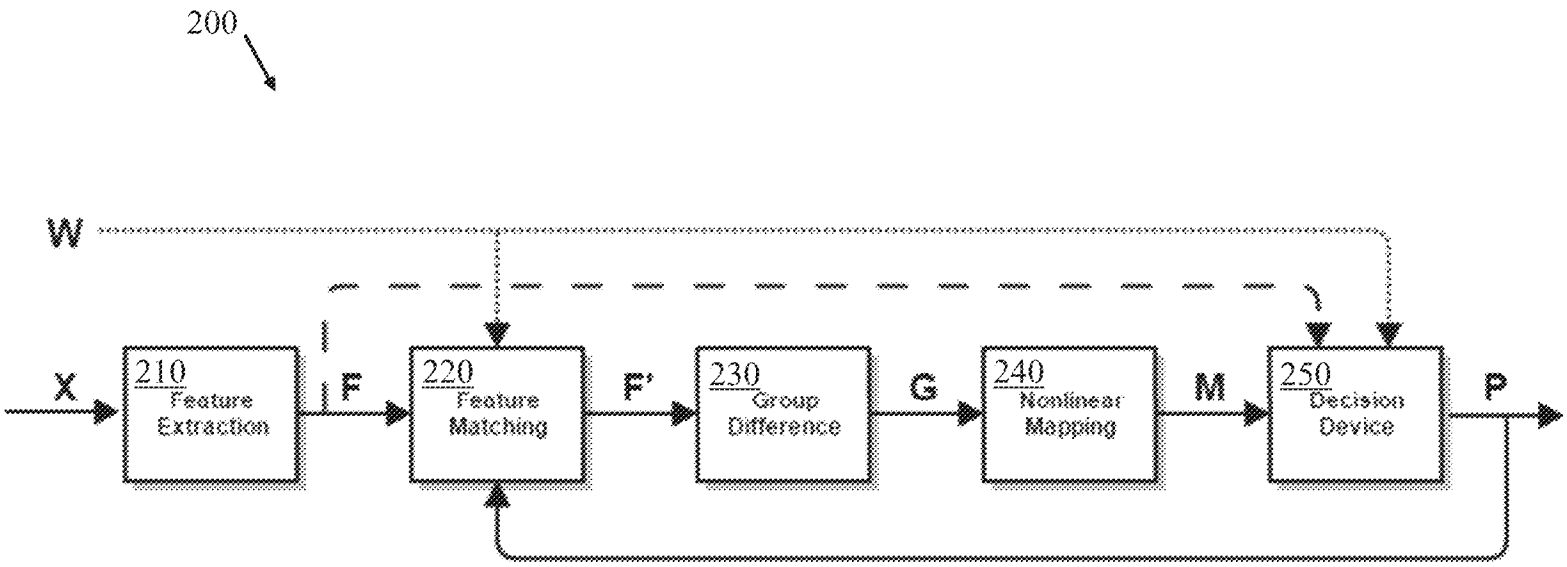
FIG. 2 schematically illustrates a generalised blocked microphone detector in accordance with one embodiment of the invention.

FIG. 2 schematically illustrates a generalised blocked microphone detector 200 in accordance with one embodiment of the invention. Blocked microphone detector 200 may for example be implemented in firmware of processor 124, and/or may be implemented in hardware, and/or may be embodied in computer readable code on a non-transitory computer readable medium such as solid state memory for example.

Blocked microphone detector 200 carries out a method to determine whether a microphone (sensor) is blocked (occluded/obstructed). By determining if a sensor is producing data of reduced quality as a result of any such blockage, this knowledge can be used to adjust multi-channel signal processing of processor 124 so that audio processing is not corrupted, or is less corrupted, by a microphone blockage. Additionally or alternatively, the knowledge that a microphone is blocked may be used to trigger an alert to the user, such as playback of recorded or synthesised spoken words informing the user of a microphone blockage and/or indicating which microphone is blocked and/or instructing the user to unblock that microphone.

The detector 200 takes information from the signals captured by sensors 111, 112, 121, 122, extracts features from these signals at 210, balances these features across channels during normal operation at 220, compares the features across microphones at 230, then applies a non-linear mapping to the features at 240. A decision device 250 then combines the information from the features to decide if a microphone is blocked.

In more detail, in the Feature Extraction module 210, features are extracted from each signal stream from the microphones 111, 112, 121, 122. In this embodiment, the extracted features comprise (i) sub-band background noise power in low frequencies (below 500 Hz), (ii) sub-band background noise power in high frequencies (above 4 kHz), (iii) total signal variation, and (iv) total signal entropy. Background noise power is defined as being the signal power present after speech is removed. The present embodiment recognises that these are particularly useful signal features to facilitate discrimination between blocked and unblocked microphones. However, alternative embodiments may additionally or alternatively extract other signal features, including but not limited to features such as signal correlation, whether autocorrelation of a single signal or cross correlation of multiple signals, signal coherence, wind metrics and the like.

To this end feature extraction module 210 extracts the following features from the microphone signal(s) of interest. First, the signal feature of sub-band background noise power is extracted at 210. This feature is computed by summing the bins within a specified range as returned by a noise estimator. The present embodiment uses minimum controlled recursive averaging (MCRA) for noise estimates, however other noise estimators could be used in alternative embodiments of the invention.

Module 210 further extracts the signal feature of Total Variation (TV), as follows:

$$TV = \sum_{n=1}^{N} |x(n) - x(n-1)|,$$

where x is the signal of interest and N is the frame length.

Module 210 further extracts the signal feature of Total Entropy (TE) as follows. For the $m^{th}$ frame, and where R is the number of frames being calculated over:

$$\overline{\xi^x(m)} = \frac{1}{K}\sum_{k=1}^{K} \xi_k^x(m) \text{ and}$$

$$\xi_k^x(m) \triangleq -\sum_{n=m-R+1}^{m} \frac{S_x(n, \omega_k)}{\sum_{l=m-R+1}^{m} S_x(l, \omega_k)} \times \log\left(\frac{S_x(n, \omega_k)}{\sum_{l=m-R+1}^{m} S_x(l, \omega_k)}\right).$$

$S_x(n, \omega_k)$ is the short time spectrum at $\omega_k$.

Feature Matching module 220 is provided because it is recognised that differences may exist in the signal features returned from microphones 111, 112, 121, 122 due to mechanical design, manufacturing variation, placement, environmental conditions etc. These differences do not however indicate that a microphone is blocked and should therefore be removed as much as possible in determining whether a microphone is blocked. To this end the feature matching module 220 matches the features across microphone signals by removing the smoothed difference of each channel from the mean value of all the sensors. This module has been shown to improve the sensitivity of the overall blocked microphone detector 200.

Feature matching module 220 matches features based on the first few seconds of data, such as the first 5 seconds of data. This assumes that no microphone is blocked when the device is switched on. Subsequently, during ongoing device operation, the feature matching is updated using a very slow time constant, slow enough that the feature matching does not or is unlikely to train to the blocked microphone condition during typical periods of microphone blockage or occlusion. If any microphone is determined as blocked, or wind is present, the feature matching is slowed down even further so that the feature matching does not train to an error condition. The matching is slowed rather than halted to avoid a false detection of a blocked microphone from locking the system in a blocked state.

Alternative methods could be used to compensate for differences across the sensors. The sensors could be matched during factory production for every device and a correction factor applied during operation. Or the sensors could be matched with an extremely slow constant and stored in memory between device restarts, however if the microphones have been matched externally to the blocked microphone detection process, or if factory correction values were available, then in some embodiments of the invention the matching rate could be set to 0.

The Group Difference module 230 operates on the premise that a sensor can be considered to be blocked if it differs from the other channels. To this end, to determine the difference between sensors, each feature is subtracted from the mean of the other channels. The present embodiment provides the following implementation:

$$G(n) = F'(n) - \frac{1}{N-1}\sum_{a=N\backslash n} F'(a),$$

where G is the group difference, F' is the matched features, N is the set of sensors; n is the sensor of interest; and N\n represents the set of sensors excluding the current sensor of interest.

Group difference module 230 generally compares the signal of interest to the mean of all the other sensors, however in certain conditions it compares the signal of interest only to a subset of the other sensors. In particular, group difference module 230 excludes comparison to channels which are suffering wind noise, as may be detected by any suitable wind noise detection technique such as that set out in WO2013091021, the content of which is incorporated herein by reference. Also, group difference module 230 excludes comparison to channels that have already been determined as blocked. In alternative embodiments of the present invention, pairwise comparisons across microphones could be used instead of group difference module 230. In other alternative embodiments of the present invention, the median of all other sensors' measures of the signal feature of interest could be used instead of the mean, to exclude extreme channels having a large effect on the result.

The Group difference module 230 could in some embodiments further embody knowledge of the form factor of the headset in use. This would allow optimisation of the Group difference module 230 based on an understanding of for example which is the "best mic on L", or "best mic on R", or, in other embodiments comprising one or more pendant microphones, "best mic on pendant". Such optimisation would allow for scenarios such as a user's headwear blocking all mics (111, 112, 121, 122) on the head to be accurately detected, because the module 230 would have unaffected signals from the pendant microphone 430 (FIG. 4, discussed further below) and the module 230 could be configured to deduce such an occurrence.

Nonlinear Mapping module 240 provides for a non-linear mapping to be applied to each feature from each microphone 111, 112, 121, 122. Nonlinear Mapping module 240 maps each feature to a unitless scale between the values of 0 and 1. This has the benefit of making the values unitless, removes the effect of outliers, and allows features on different scales to be easily combined in the decision device 250. Nonlinear Mapping module 240 uses a sigmoid function with pre-specified threshold and slope, although in other embodiments the threshold and slope of the sigmoid function may be variable and may be controlled by another parameter such as background noise or other environmental effects on the signals.

The sigmoid function implemented by Nonlinear Mapping module 240 is:

$$S(z)' = \frac{1}{1 + e^{-k*(z-x0)}},$$

where x0 is the value being mapped, z is the threshold parameter, and k represents the slope of the function.

A key issue to note in relation to the non-linear mapping adopted by the present invention is that the various metrics employed are measured on different scales, in different units. For example, noise is on a dB scale while Total Variation has units the same as the units for x(n). To normalise such metrics from varied scales to a common normalised scale is a key enabler of the decision module 250.

The normalisation map of each metric can be done via sigmoid mapping or piecewise linear mapping, for example. The lower and upper cutoffs and centrepoint of transition can be defined by identifying a lower point at which the mic is "definitely not blocked", and identifying an upper point at which the mic is "definitely blocked", and imposing the transition from 0 to 1 between those two points. For example, a total variation of 5 dB is normal for unblocked mics (due to spatial effects and the like) so that 5 dB represents a suitable lower cutoff of a mapping transition. Further, 20 dB total variation is "definitely blocked", making 20 dB a suitable upper cutoff of the mapping transition. Accordingly, in this embodiment the sigmoid for Total Variation mapping is fitted so as to transition from 0 to 1 in the 5-20 dB range (12.5 dB is mid point). In some embodiments, the corner points of the normalisation map (in this case, 5 dB and 20 dB) can be adaptive, e.g these corner points or cutoffs might be adapted so as to rise in noisy environments and fall in quiet environments.

The threshold and slope values used by the Nonlinear Mapping module 240 are based on observations from a large set of recordings that were taken in different environments and conditions with the microphones blocked and unblocked.

In alternative embodiments of the decision device 250, other mapping functions can be used, such as a mapping between −1 and 1.

Figure 3:
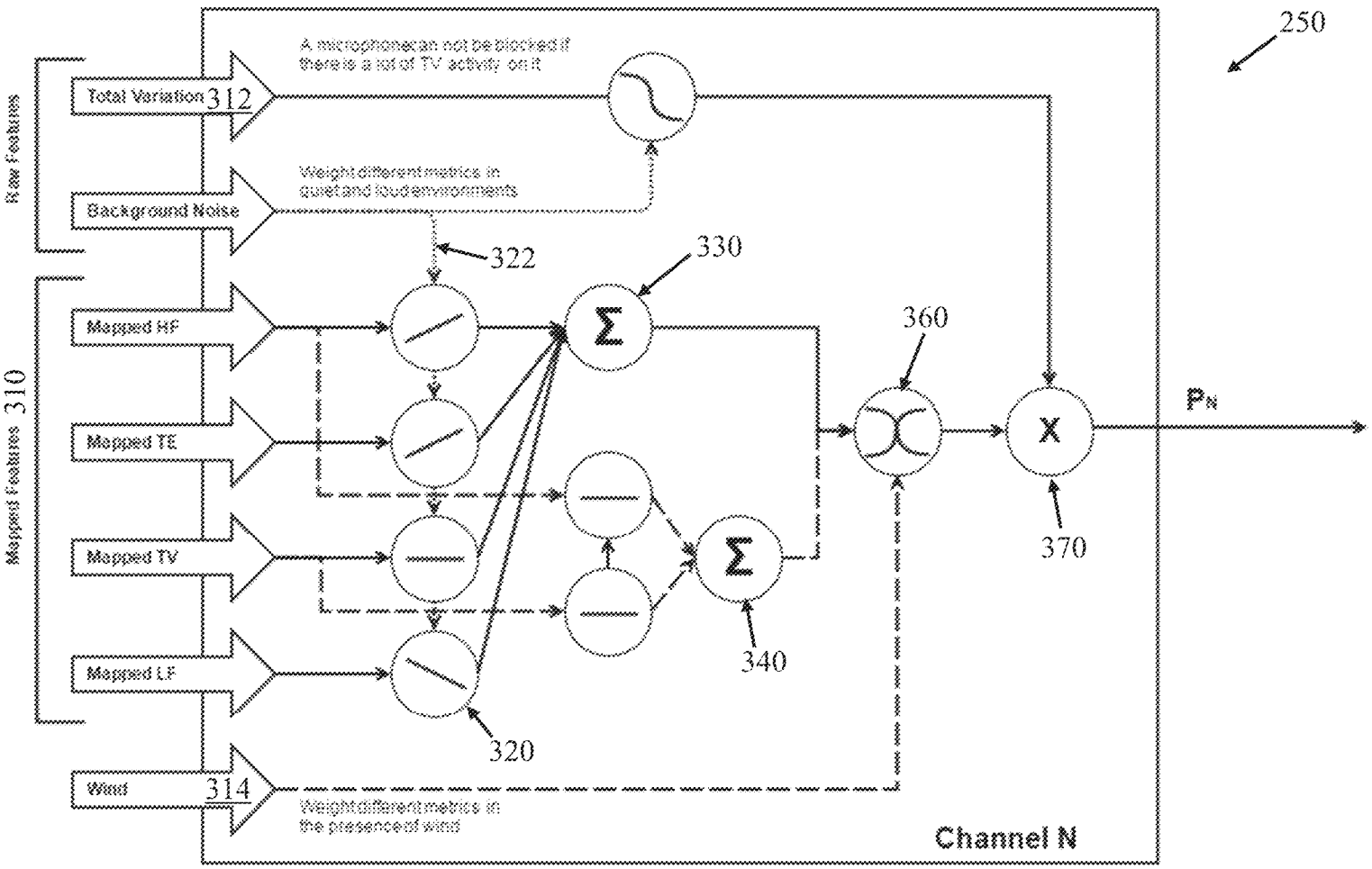
FIG. 3 schematically illustrates a decision device configured to determine whether a microphone is blocked.

Decision Device 250 combines information from the mapped features to decide if a microphone is blocked. FIG. 3 illustrates the decision device 250 in more detail. The mapped features 310, comprising mapped high frequency feature, mapped total entropy feature, the mapped total variation feature, and the mapped low frequency feature, are weighted at 320 and summed at 330, 340 to provide the output. A unique weighting is applied to each signal feature at 320, only one of which is indicated by numeral 320 in FIG. 3. Moreover, while the weighting 320 and all other weighting blocks are shown in a circle as being a linear weighting, each weighting is a sigmoid weighting as described in the preceding, with the direction of the depicted line merely indicating the orientation of the respective sigmoid function. The weighting 320 applied to each of the mapped features 310 is dependent on the environment, specifically the background noise and presence of wind, as indicated by control line 322.

A gating is applied at 370 to ensure that channels with high levels of activity are not marked as blocked. To this end, the Total Variation 312 is passed through a sigmoid having a threshold which is dependent on the background noise, and is then used to gate the output at 370 by being multiplied with the weighted sum of mapped features. In alternative embodiments, any suitable alternative metric may be used to gate the output at 370.

Similarly, the presence or absence of wind noise, as indicated by metric 314, is used at 360 to change the weighting given to different metrics. In particular, in the absence of wind noise the output of combiner 330, based on all metrics 310, is weighted more heavily at 360. However, in the presence of wind noise, the mapped LF and Mapped TE metrics, which are more corrupted by wind, are de-emphasised by weighting the output of combiner 340 more heavily at 360. The wind noise metric could be a scalar (e.g. a wind speed estimate), or binary (wind/no wind).

The weights of the different features vary with the background noise, as indicated by 322. The mapping is done via a logistic function. The threshold and slope applied in each type of background noise conditions is based on observations that certain features are effective in different conditions. To create a suitable logistic function the difference between the blocked and unblocked values of each metric were plotted against the background noise level and a sigmoid function was fitted to this data. The values from the fitted sigmoid were used in the decision device 250 to adaptively control the weightings 320. For example, background noise is weighted less in quiet conditions as it is not an effective measure if there is little background noise, whereas it is weighted heavily in noisy conditions. Alternative methods could be used to choose the device weights, for example a genetic algorithm could try different combinations of values, and determine which values minimise the amount of false detections of microphone blockage.

Another advantage of the fused output being provided in a range, rather than as a binary indicator, is that different downstream functions can use such graduated data in an appropriate manner based on just how significantly a blocked microphone effects each such downstream function. That is, this blocked mic detection block produces a "soft" output which allows each downstream process to make its own response as to how badly a blocked microphone scenario will affect performance Alternative decision devices are possible in accordance with other embodiments of the present invention. In the above-described embodiment a decision device is hand coded based on observations. In alternative embodiments, a machine learning technique such as a neural network could be used to decide if a microphone is blocked based on a training set of data. The embodiment of FIGS. 1-3 uses the features to predict if a microphone is blocked, in alternative embodiments it may be possible to use features to indicate the microphone is not blocked, and to combine the evidence in a polling system.

Blocked microphone detector 200 thus provides for the detection of one or more blocked microphones in headset 100. This algorithm combines information from several extracted features, and notably, the way the information is merged is dependent on the environment. This produces accurate estimates of which microphone is blocked.

Notably, recognising that a microphone may be blocked only briefly, the present invention provides for the adjustment of the multi-channel signal processing to occur in substantially real time so that when the microphone becomes unblocked the multi-channel signal processing can be promptly returned to an original state.

Blocked microphone detector 200 is configured to function accurately in all acoustic environments, and is computationally cheap, which is particularly important in embodiments utilising an earbud DSP or headset DSP with limited power budget and processing power. This is achieved by merging the information from various signal features, with the weights applied to each feature being dependent on environmental conditions including background noise, total variation and wind. Notably, this approach is in contrast to an approach of comparing two signals in order to generate a single metric, recognising that any single metric tends to have different efficacy in different acoustic environments.

Another feature of the blocked microphone detector 200 is in response to the scenario of a very silent room: while some individual metrics may not produce a meaningful output in silence, the present embodiment notes that the detector 200 can be disabled because the microphone outputs, whether blocked or not, contain little or no signal of interest.

The Decision Device 250 in this embodiment takes inputs only in the range of 0-1. It emphasises or de-emphasises inputs from the various metrics depending on the detected environment (noise, wind, total variation), as described above. Such a linear combiner has been shown to work well, and is simple to implement. However more complex alternatives may be employed within the scope of the present invention, including for example a neural network.

The present embodiment thus recognises that it is desirable to provide audio processing systems with a means to detect a blocked microphone, and further recognises that approaches which rely on a single signal feature may work in some acoustic environments but will fail to detect a blocked microphone in a wide range of other acoustic environments. For example, the use of only sub-band power may work to differentiate some instances of a blocked microphone, but only if there is sufficient background noise, and will perform insufficiently in other acoustic environments. Similarly, beamformer distortion may be used as an indicator of a blocked microphone, but this approach only works if a target for the beamformer is present, and this metric will be inadequate in other acoustic environments. In contrast, the present invention derives multiple features and variably weights each feature in response to observed acoustic conditions in the microphone signals. The present embodiment further provides a computationally efficient approach to blocked microphone detection.

While the detector 200 is shown as operating only on a single microphone input, it is to be appreciated that blocked microphone detection may be carried out in parallel for any or all of the microphones 111, 112, 121, 122. Moreover, a wide range of headset form factors exist or may be developed in relation to which embodiments of the present invention may be adapted in order to effect blocked microphone detection. For example, each wireless earbud in FIG. 1 may an alternative embodiments be provided with one, or with more than two, microphone(s). Each earbud may be provided with a processor configured to undertake blocked microphone detection. The processor of each earbud may undertake blocked microphone detection on the basis of only the microphone signals derived from microphones of that earbud. However it is preferable for the processor of each earbud to undertake blocked microphone detection on the basis of microphone signals captured by the other earbud and/or by at least one other part of the headset, in order to make such detection more robust to scenarios where one entire earbud is covered or occluded.

Moreover, the communications between earbuds effected by transceiver 126 may in some embodiments comprise the entire data stream of each microphone from a first earbud to a second earbud, in order for a processor of the second earbud to process microphone data from both earbuds. In alternative embodiments the communications between earbuds may comprise signal parameters or data values reflecting an extant state of signal features of interest, the signal features of a microphone of a first earbud being determined by a processor of that earbud and then communicated from the first earbud to the second earbud, with such embodiments providing the benefit of reduced inter-earbud data rates and power consumption.

Figure 4A:
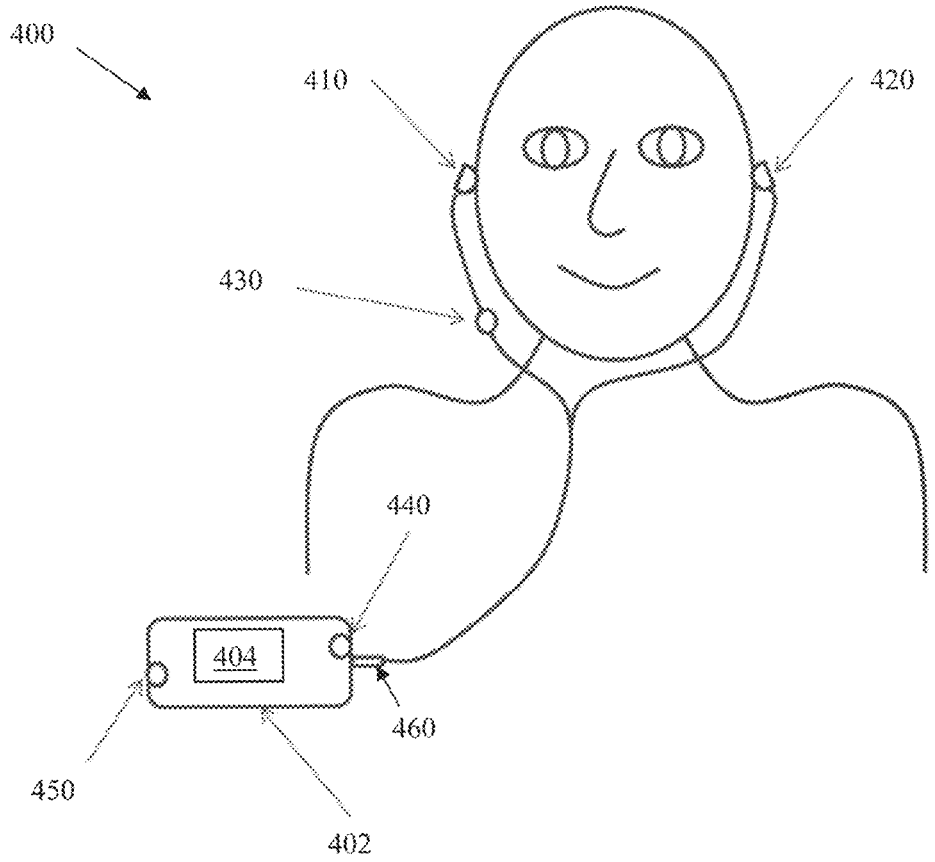
FIG. 4*a* and FIG. 4*b* illustrate a signal processing system implementing blocked microphone detection, in accordance with another embodiment of the invention.
Figure 4B:
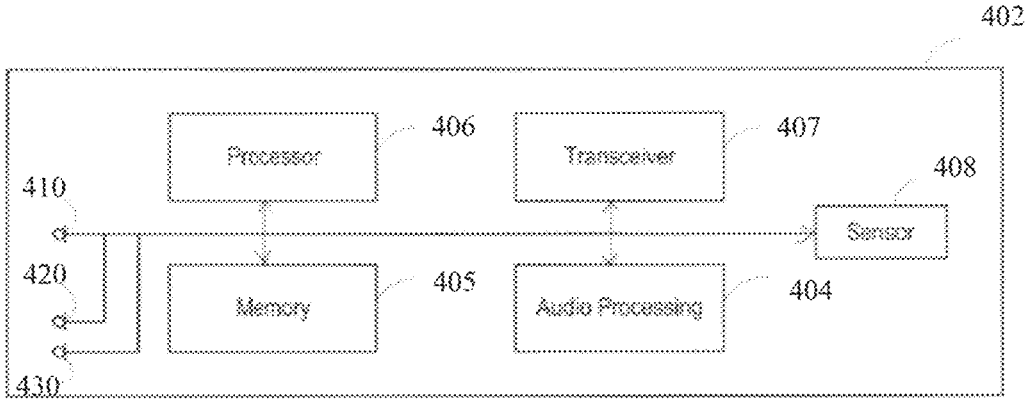

FIG. 4*a* and FIG. 4*b* illustrate a signal processing system 400 in accordance with another embodiment of the invention, in which blocked microphone detection is implemented. An audio signal processor 404 of smartphone 402 is configured to receive microphone signals from earbud microphones 410, 420, pendant microphone 430, and phone-mounted microphones 440, 450. The earbuds and pendant may each comprise one microphone, or more than one microphone. Smartphone 402 is configured for a user to listen to music or audio, to make telephone calls, and to deliver voice commands to a voice recognition system, and other such audio processing functions.

FIG. 4*b* shows various interconnected components of the smartphone 402. It will be appreciated that the smartphone 402 will in practice contain many other components, but the following description is sufficient for an understanding of the present invention. Thus, FIG. 4*b* shows the microphones 410, 420, 430 for illustrative purposes as inputs to smartphone 402. FIG. 4*b* shows audio processing circuitry 404, for performing operations on the audio signals detected by the microphones as required. For example, the audio processing circuitry 20 may filter the audio signals or perform other signal processing operations. FIG. 4*b* also shows a memory 405, which may in practice be provided as a single component or as multiple components. The memory 405 is provided for storing data and program instructions. FIG. 4*b* also shows a processor 406, which again may in practice be provided as a single component or as multiple components. For example, one component of the processor 406 may be an applications processor of the smartphone 402. FIG. 4*b* also shows a transceiver 407, which is provided for allowing the smartphone 402 to communicate with external networks. For example, the transceiver 407 may include circuitry for establishing an internet connection either over a WiFi local area network or over a cellular network. Processor 404 is further configured to adapt the handling of such audio processing functions in response to occasions when one or more of the microphones 410, 420, 430, 440, 450 are blocked, obstructed or occluded, as for example may be caused by the user touching or covering the respective microphone port(s), or by the ingress of dirt, clothing, hair or the like into the respective microphone port(s). Such blocked microphone detection can be performed by processor 404 executing detector 200, or the like.

While in this embodiment the audio processor 404 executes detector 200, other embodiments may take the same form factor as FIG. 4 except that the digital signal processor executing detector 200 may instead be positioned in the headset itself, such as in the connector (or jack) (460), the pendant (430), either or both earbuds (410, 420), or anywhere else in the headset. Such embodiments are to be considered to be within the scope of the present invention. Such alternative embodiments may be powered by a battery of smartphone 402, or for example in the case of a wireless headset the headset-mounted DSP may be powered by a co-located power supply.

Corresponding reference characters indicate corresponding components throughout the drawings.

It will be appreciated by persons skilled in the art that numerous variations and/or modifications may be made to the invention as shown in the specific embodiments without departing from the spirit or scope of the invention as broadly described. For example, while FIG. 4 illustrates a system in which a smartphone has wired earbuds, alternative embodiments may comprise a smartphone communicating wirelessly with wireless earbuds.

In some embodiments of the invention, full band power FBP may additionally or alternatively be extracted by feature extraction module 210, by calculating:

$$FBP = \frac{1}{N}\sum_{0}^{N-1}|x(n)|^2,$$

where x is the signal of interest and N is the frame length. FBP was omitted from the embodiments described above, as it was found to respond non-optimally to speech in certain microphone configurations. However, in alternative embodiments with other microphone configurations FBP may be an appropriate feature to use for blocked microphone detection.

The skilled person will thus recognise that some aspects of the above-described apparatus and methods, for example the calculations performed by the processor may be embodied as processor control code, for example on a non-volatile carrier medium such as a disk, CD- or DVD-ROM, programmed memory such as read only memory (firmware), or on a data carrier such as an optical or electrical signal carrier. For many applications, embodiments of the invention will be implemented on a DSP (Digital Signal Processor), ASIC (Application Specific Integrated Circuit) or FPGA (Field Programmable Gate Array). Thus the code may comprise conventional program code or microcode or, for example, code for setting up or controlling an ASIC or FPGA. The code may also comprise code for dynamically configuring re-configurable apparatus such as re-programmable logic gate arrays. Similarly the code may comprise code for a hardware description language such as Verilog™ or VHDL (Very high speed integrated circuit Hardware Description Language). As the skilled person will appreciate, the code may be distributed between a plurality of coupled components in communication with one another. Where appropriate, the embodiments may also be implemented using code running on a field-(re)programmable analogue array or similar device in order to configure analogue hardware.

Embodiments of the invention may be arranged as part of an audio processing circuit, for instance an audio circuit which may be provided in a host device. A circuit according to an embodiment of the present invention may be implemented as an integrated circuit.

Embodiments may be implemented in a host device, especially a portable and/or battery powered host device such as a mobile telephone, an audio player, a video player, a PDA, a mobile computing platform such as a laptop computer or tablet and/or a games device for example. Embodiments of the invention may also be implemented wholly or partially in accessories attachable to a host device, for example in active speakers or headsets or the like. Embodiments may be implemented in other forms of device such as a remote controller device, a toy, a machine such as a robot, a home automation controller or the like.

It should be noted that the above-mentioned embodiments illustrate rather than limit the invention, and that those skilled in the art will be able to design many alternative embodiments without departing from the scope of the appended claims. The use of "a" or "an" herein does not exclude a plurality, and a single feature or other unit may fulfil the functions of several units recited in the claims. Any reference signs in the claims shall not be construed so as to limit their scope.

The present embodiments are, therefore, to be considered in all respects as illustrative and not restrictive.

The invention claimed is:

1. A signal processing device for detecting a blocked microphone, the device comprising:

a plurality of inputs for receiving respective microphone signals from a plurality of microphones; and a processor configured to derive from the microphone signals a plurality of signal feature measures, the processor further configured to normalise the signal feature measures; the processor further configured to variably weight the normalised signal feature measures in response to detected environmental conditions in the microphone signals; the processor further configured to combine the variably weighted normalised signal feature measures to produce an output indication of whether a microphone is blocked.

2. The signal processing device of claim 1 wherein the processor is configured to normalise the signal feature measures by applying a non-linear mapping of each signal feature measure to a unitless reference scale.

3. The signal processing device of claim 2 wherein the non-linear mapping comprises a sigmoid function.

4. The signal processing device of claim 3 wherein the sigmoid function applies a threshold and a slope which are each responsive to observed conditions.

5. The signal processing device of claim 3 wherein the sigmoid function is configured by reference to control observations of blocked and unblocked microphones.

6. The signal processing device of claim 1 wherein combining the variably weighted normalised signal feature measures comprises determining a group difference of a signal feature measure of one microphone as compared to the signal feature measure of at least one other of the microphones.

7. The signal processing device of claim 6 wherein the signal feature measure of the one microphone is compared to the signal feature measure of only those other microphones which are not experiencing wind noise.

8. The signal processing device of claim 6 wherein the signal feature measure of the one microphone is compared to the signal feature measure of only those other microphones which are not blocked.

9. The signal processing device of claim 1 wherein the plurality of signal feature measures comprises total signal variation.

10. The signal processing device of claim 1 wherein the plurality of signal feature measures comprises total entropy.

11. The signal processing device of claim 1 wherein the plurality of signal feature measures comprises signal correlation.

12. The signal processing device of claim 1 wherein the plurality of signal feature measures comprises coherence.

13. The signal processing device of claim 1 wherein the plurality of signal feature measures comprises a wind metric.

14. The signal processing device of claim 1 wherein the processor is further configured to apply feature matching in order to account for differences arising in the signal features for reasons other than microphone blockage.

15. A method for detecting a blocked microphone, the method comprising:

receiving respective microphone signals from a plurality of microphones;

deriving from the microphone signals a plurality of signal feature measures;

normalising the signal feature measures;

variably weighting the normalised signal feature measures in response to detected environmental conditions in the microphone signals; and combining the variably weighted normalised signal feature measures to produce an output indication of whether a microphone is blocked.

16. The method of claim 15 wherein normalising the signal feature measures comprises applying a non-linear mapping of each signal feature measure to a unitless reference scale.

17. The method of claim 16 wherein the non-linear mapping comprises a sigmoid function.

18. The method of claim 17 wherein the sigmoid function applies a threshold and a slope which are each responsive to observed conditions.

19. A non-transitory computer readable medium for detecting a blocked microphone, comprising instructions which, when executed by one or more processors, causes performance of the following:

receiving respective microphone signals from a plurality of microphones;

deriving from the microphone signals a plurality of signal feature measures;

normalising the signal feature measures;

variably weighting the normalised signal feature measures in response to detected environmental conditions in the microphone signals; and combining the variably weighted normalised signal feature measures to produce an output indication of whether a microphone is blocked.

20. A system for detecting a blocked microphone, the system comprising a processor and a memory, the memory containing instructions executable by the processor and wherein the system is operative to:

receive respective microphone signals from a plurality of microphones;

derive from the microphone signals a plurality of signal feature measures;

normalise the signal feature measures;

variably weight the normalised signal feature measures in response to detected environmental conditions in the microphone signals; and combine the variably weighted normalised signal feature measures to produce an output indication of whether a microphone is blocked.

* * * * *